US006059093A

United States Patent [19]

Merkli

[11] Patent Number: 6,059,093

[45] Date of Patent: May 9, 2000

[54] DEVICE FOR TRANSPORTING PRINTED SHEETS

[75] Inventor: Peter Merkli, Oftringen, Switzerland

[73] Assignee: GRAPHA-Holding AG, Switzerland

[21] Appl. No.: 08/840,637

[22] Filed: Apr. 25, 1997

[30] Foreign Application Priority Data

May 7, 1996 [CH] Switzerland ..... 1159/96

[51] Int. Cl.[7] ..... B65H 5/32

[52] U.S. Cl. ..... 198/644; 198/690.2

[58] Field of Search ..... 198/644, 731, 198/817, 699, 690.2

[56] References Cited

U.S. PATENT DOCUMENTS

| | | | |
|---|---|---|---|
| 1,492,760 | 5/1924 | Sproul | 198/644 |
| 1,601,802 | 10/1926 | Kast | 198/644 |
| 1,614,717 | 1/1927 | Christensen | 198/644 |
| 2,810,468 | 10/1957 | Faeber et al. | 198/644 |
| 2,856,064 | 10/1958 | De Windt | 198/690.2 |
| 3,362,304 | 1/1968 | Skolnick | 198/644 |
| 3,807,547 | 4/1974 | Mueller | 198/644 |
| 4,546,961 | 10/1985 | Majewski et al. | 198/644 |
| 4,770,284 | 9/1988 | Boss | 198/644 |
| 5,081,821 | 1/1992 | Meives | 198/644 |
| 5,404,994 | 4/1995 | Brandenberger | 198/690.2 |
| 5,853,081 | 12/1998 | Hastie | 198/644 |

FOREIGN PATENT DOCUMENTS

0681923A1 11/1995 European Pat. Off. .

*Primary Examiner*—Robert P. Olszewski
*Assistant Examiner*—Thuy V. Tran
*Attorney, Agent, or Firm*—Venable; Robert Kinberg

[57] ABSTRACT

A device for transporting printed sheets includes a first traction element and a support attached to the first traction element for movement therewith in a transport direction. The printed sheets are deposited in adjacent stacks on the support. Windshield elements are arranged respectively between adjacent stacks of sheets deposited on the support for holding down the deposited printed sheets with a use of environmental air.

8 Claims, 2 Drawing Sheets

DEVICE FOR TRANSPORTING PRINTED SHEETS

BACKGROUND OF THE INVENTION

The invention concerns a device for transporting printed sheets, in particular in a gathering and stitching machine or an assembling machine having a traction element to which there is connected a saddle-shaped support or an approximately level support on which the printed sheets are successively deposited in adjacent stacks, either straddling the saddle-shaped support or forming a piles of sheets on the level support, and particularly to such a device having a mechanism for holding down the deposited printed sheets.

Gathering and stitching, as well as assembling machines, are well known. European application EP-A-0 681 923, for example, shows a gathering and stitching machine with a device of the generic type, wherein a traction element is provided with a saddle-shaped support which transports the printed sheets that are successively deposited thereon in a straddling manner by distributors. In assembling machines the support is level and moves in a horizontal conveying direction. The traction element in this case can be an endlessly circulating belt. In order to increase the capacity of gathering and stitching machines and assembling machines, it has long been a desire to transport the printed sheets in the aforementioned device at higher speeds than has been possible so far. The difficulty here is that, in particular, thin and light weight printed sheets will lift off, fly away or the edges will be folded over, which leads to interruptions in the continued processing of the printed sheets. It is a known practice to exert control over the printed sheets during the transport by aiming a blast of air at them, weighing them down with brake springs or holding them down, for example with brushes. However, blast air is hard to control and can have disadvantageous effects in addition to being expensive. Hold-down devices have the essential disadvantage that access to the printed sheets is limited during transport and the known hold-down devices in each case must be adjusted exactly to the respective products.

SUMMARY OF THE INVENTION

It is an object of the invention to provide a device for transporting printed sheets that avoids the above-mentioned difficulties, including interruptions due to printed sheets flying away and thus permits operation at higher speed.

The above and other objects are accomplished according to the invention by the provision of a device for transporting printed sheets, comprising: a first traction element arranged for being driven in a transport direction; a support attached to the first traction element for movement with the first traction element in the transport direction and on which the printed sheets are deposited in adjacent stacks; and windshield elements arranged respectively between adjacent stacks of sheets deposited on the support for holding down the deposited printed sheets with a use of environmental air.

For a device of the generic type, the solution according to the invention is that the aforementioned mechanism for holding down the printed sheets comprises windshield elements that move along with the printed sheets and are designed to keep away or carry along environmental air in the region of the printed sheets. These windshield elements are preferably arranged such that one element is arranged between each pair of adjacent printed sheet stacks or piles.

Such windshield elements permit a start-up with a higher acceleration since a start-up whirl or eddy develops through the windshield elements, which press the sheets against their support and thus also hold down the sheets. Such windshield elements restrict access to the printed sheets only insignificantly and are easily maintained.

The windshield elements can be fastened directly to the traction element. For a modification of the invention, the windshield elements are attached to another traction element. The other traction element may be, for example, an endlessly circulating belt. According to another modification of the invention, the windshield elements have, at least in part, a flexible or elastic design, that can yield in case of blockages.

According to another modification based of the invention, the windshield elements are fastened so that they can be removed or adjusted, in particular, folded down or swiveled, which permits an optimum adaptation of these elements to the printed product format. This is achieved in that the windshield elements are attached to the traction element such that they can be lowered and/or moved.

BRIEF DESCRIPTION OF THE DRAWINGS

Two exemplary embodiments of the invention are explained in more detail in the following with the aid of the drawing.

DETAILED DESCRIPTION OF THE INVENTION

Figure 1:
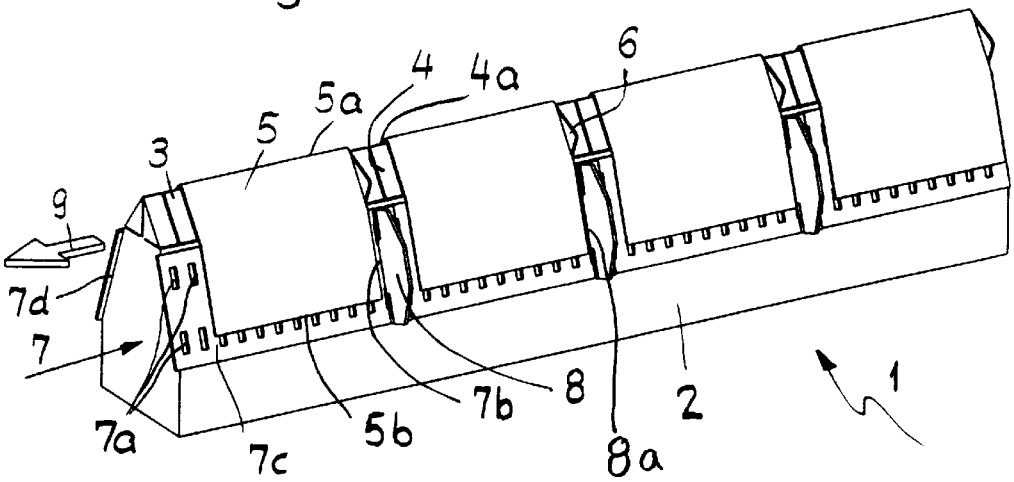
FIG. 1 is a perspective view of a diagram of a segment of the inventive device which is intended for a gathering and stitching machine.

Referring to FIG. 1, there is shows a diagram of a segment 1 of a gathering section 2 for a gathering and stitching machine (not shown). The basic layout of such a gathering section is disclosed in the above-mentioned European patent application EP-A-0 681 923, the disclosure of which is incorporated herein by reference. The gathering section 2 has a traction element 3, which is preferably a known link roller chain, which has carriers 6 that are adjusted to the operating cycle of the gathering and stitching machine and are attached to it. These carriers 6 receive printed sheets 5 in a straddling manner from feeders, which are not shown here. Traction element 3 comprises an uninterrupted saddle-shaped support 4 with an upper edge 4*a*, on which printed sheets 5 that are folded along a line 5*a* loosely rest. Printed sheets 5 have a lower edge 5*b* that is parallel to folding line 5*a*, of which only the front lower edge is visible here. Printed sheets 5 are held in the shown position only by their own weight. Traction element 3 has a transporting direction indicated by an arrow 9 and thus moves in FIG. 1 from right to left.

Figure 4:
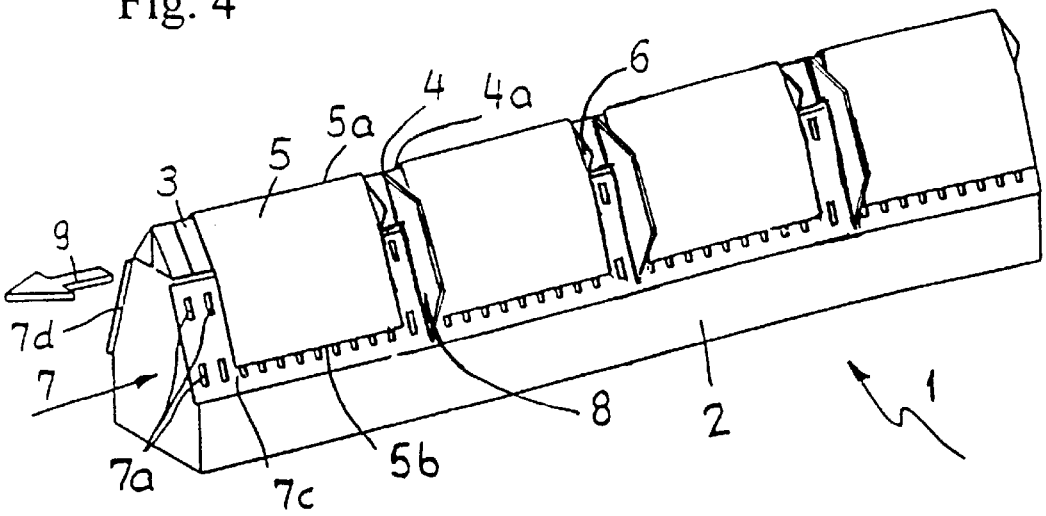
FIG. 4 is a perspective view of a segment of the invention device as shown in FIG. 1 and depicting an alternative location for attachment of the windshield elements.
Figure 5:
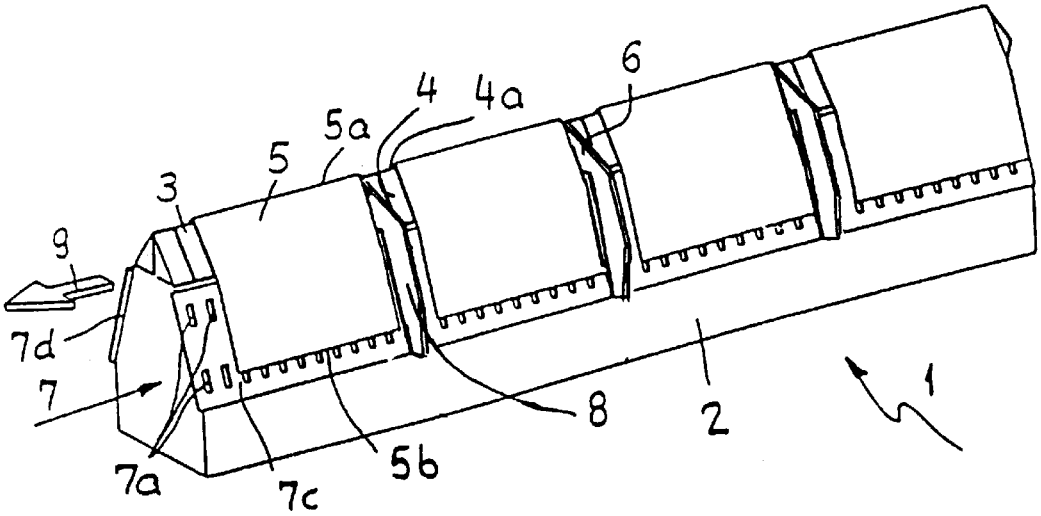
FIG. 5 is a perspective view of a segment of the inventive device as shown in FIG. 1 and depicting still another alternative location for attachment of the windshield elements.

Two windshield elements 8 are arranged on opposite sides of the saddle-shaped support 4, respectively, between adjacent sheets 5, or stacks of such printed sheets, wherein only the front windshield elements are visible in FIG. 1. Windshield elements not visible in FIG. 1 are positioned in a mirror-inverted arrangement on the here not visible rear side of gathering section 2. Windshield elements 8 are moved along synchronously in the direction of arrow 9 during the transport of printed sheets 5. The shown distances between windshield elements 8 and the neighboring printed products 5 thus are retained during transport. As depicted in FIGS. 4 and 5, windshield elements 8 may be attached to the traction element 3 and/or the carriers 6. Alternatively, windshield element 8 are moved with an additional traction element 7, comprising two endlessly circulating belts 7*c* and 7*d* that face each other. These belts 7*d* and 7*c* are preferably clocked such that they move synchronously with traction element 3. Belts 7*d* and 7*c* have openings 7*a* at uniform distances via which they can be driven by a drive mechanism which is not shown. Suitable drives are known per se and do not have to be discussed here in detailed.

Windshield elements 8 are respectively provided with a fastening component 8*a*, which is inserted into a vertical slot 7*b* of belt 7*c* or 7*d*. Windshield elements 8 are preferably fastened so that they can be lowered as well as vertically displaced. It is also possible to have a fastener that permits a folding down or swiveling of windshield elements. Windshield elements 8 preferably are composed of a flexible or elastic plastic and are plate-shaped as can be seen. Windshield elements 8 extend approximately vertically downward and project at an approximate right angle from the outside of belt 7*c* or 7*d*, respectively. On their bottom, windshield elements 8 project somewhat over the lower edge 5*b* of printed sheets 5, however, this is not imperative. With this, the lower frontal edge 5*b* of each printed sheet 5 in particular is on the leeward side of a windshield element 8.

Figure 2:
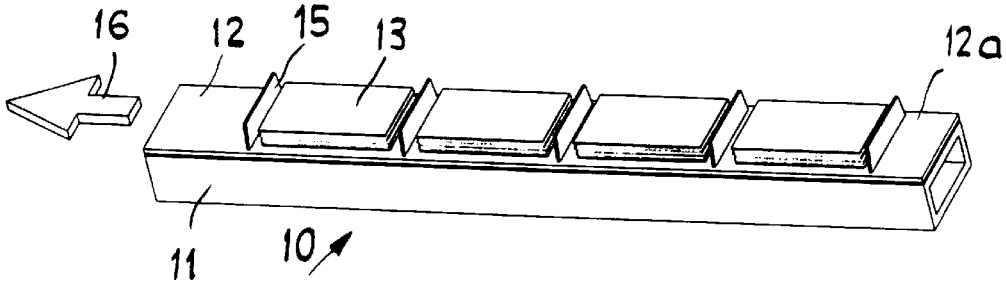
FIG. 2 is a perspective view of a diagram of a segment of another embodiment of the device for use with an assembling machine.
Figure 3:
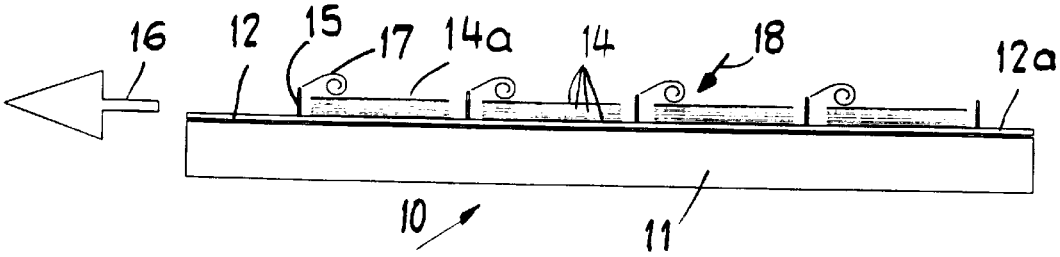
FIG. 3 is a side elevation of a diagram of a segment of the device according to FIG. 2 for explaining the principles of the invention.

FIGS. 2 and 3 show segments of an assembling section 11 for an assembling machine 10 that is known per se. Sheet piles 13 containing a plurality of printed sheets 14 are transported in the direction of arrow 16. Windshield elements 15 that correspond to windshield elements 8 are here attached to a traction element 12, which can be an endlessly circulating belt. Windshield elements 15 are respectively arranged between adjacent printed sheets piles 13.

The effect of windshield elements 8 shown in FIGS. 1, 4 and 5 and windshield elements 15 shown in FIGS. 2 and 3 is explained in more detail in the following, with particular reference being made to FIG. 3. As can be seen, each windshield element 15 projects somewhat over the top printed sheet 14*a* of a respective one of the printed sheet piles. During a start-up of traction element 12, sheet piles 13 are on principle subjected to a driving wind as a result of resting environmental air. This wind causes a whirl or eddy 17 behind each windshield element 15, which exerts a hold-down pressure in the direction of arrow 18 onto upper sheet 14*a*. The same hold down effect occurs with respect to sheet 5 in FIGS. 1, 4 and 5. As a result of this, the total sheet pile 13 is held down against the supporting surface 12*a* of traction element 12. Thus, a flying away of the sheet or the bending of an edge is avoided, even with a strong acceleration. Once a constant transporting speed is reached following start-up, windshield elements 15 or 8 cause the environmental air above the sheet pile 13 or the printed sheet 5 to be carried along. As a result of this, the printed sheets are subjected much less to the driving wind, and correspondingly higher transporting speeds can be used.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A device for transporting printed sheets, comprising:

a first traction element arranged for being driven in a transport direction;

a support attached to the first traction element for movement with the first traction element in the transport direction, and wherein the support has a saddle-shape and the printed sheets are deposited in a manner to straddle the saddle-shaped support in adjacent stacks; and windshield elements arranged respectively between adjacent stacks of sheets deposited on the support for holding down the deposited printed sheets with use of environmental air.

2. A device according to claim 1, wherein the windshield elements are fastened to the first traction element.

3. A device according to claim 1, and further including carriers for the printed sheets arranged on the traction element, wherein the windshield elements are each attached to a respective one of the carriers.

4. A device according to claim 1, and further including an additional traction element running in parallel direction with the first traction element and the windshield elements are attached to the additional traction element.

5. A device according to claim 4, wherein the additional traction element is an endlessly circulating belt.

6. A device according to claim 4, wherein the movement of the additional traction element is synchronized with the movement of the first traction element.

7. A device according to claim 1, wherein the windshield elements project at an approximate right angle from the support and essentially extend lateral to the direction of transport.

8. A device according to claim 1, wherein the windshield elements are flexible or elastic at least in segments.

* * * * *